US006602053B2

(12) United States Patent
Subramanian et al.

(10) Patent No.: US 6,602,053 B2
(45) Date of Patent: Aug. 5, 2003

(54) COOLING STRUCTURE AND METHOD OF MANUFACTURING THE SAME

(75) Inventors: Ramesh Subramanian, Oviedo, FL (US); Mercedes Keyser, Cocoa Beach, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 23 days.

(21) Appl. No.: 09/921,084

(22) Filed: Aug. 2, 2001

(65) Prior Publication Data

US 2003/0026697 A1 Feb. 6, 2003

(51) Int. Cl.[7] ..... F01D 5/18

(52) U.S. Cl. ..... 416/97 R; 416/241 R; 416/241 B

(58) Field of Search ..... 416/97 R, 241 B, 416/241 R; 415/200; 205/118, 170, 205, 220, 221, 223

(56) References Cited

U.S. PATENT DOCUMENTS

| | | | | | |
|---|---|---|---|---|---|
| 2,641,439 | A | * | 6/1953 | Williams | 416/90 R |
| 3,678,570 | A | * | 7/1972 | Paulonis et al. | 228/194 |
| 3,806,276 | A | * | 4/1974 | Aspinwall | 416/97 R |
| 4,528,048 | A | * | 7/1985 | Gell et al. | 416/241 R |
| 4,623,087 | A | * | 11/1986 | Conolly | 416/241 R |
| 4,629,397 | A | * | 12/1986 | Schweitzer | 416/96 R |
| 4,769,309 | A | * | 9/1988 | King et al. | 430/311 |
| 5,640,767 | A | * | 6/1997 | Jackson et al. | 29/889.721 |
| 5,875,549 | A | * | 3/1999 | McKinley | 29/889.2 |
| 6,018,950 | A | | 2/2000 | Moeller | |
| 6,149,160 | A | | 11/2000 | Stephens et al. | |
| 6,203,927 | B1 | * | 3/2001 | Subramanian et al. | 416/241 B |
| 2002/0141872 | A1 | * | 10/2002 | Darolia et al. | 416/241 R |

FOREIGN PATENT DOCUMENTS

| | | | | |
|---|---|---|---|---|
| EP | 113883 | A2 | * 7/1984 | B23P/19/04 |

OTHER PUBLICATIONS

Kelly, Kevin W. High Aspect Ratio Microstructure–Supported Shroud for a Turbine Blade. Elevated Temperature Coatings: Science and Technology II. Edited by J.M. Hampikian, et al. The Minerals, Metals & Materials Society, 1999. pp. 173–184.

* cited by examiner

*Primary Examiner*—Edward K. Look
*Assistant Examiner*—Richard A. Edgar

(57) ABSTRACT

A method of forming a cooling feature (28) on a surface (14) of a substrate (12) to protect the substrate from a high temperature environment. The cooling feature is formed by first depositing a layer of a masking material (16) such as epoxy resin on the surface of the substrate. A pattern of voids (18) is then cut into the masking material by a laser engraving process which exposes portions of the substrate surface. A plurality of supports (20) are then formed by electroplating a support material onto the exposed portions of the substrate surface. A layer of material is then electroplated onto the supports and over the masking material to form a skin that interconnects the supports. Finally, the remaining portions of the masking material are removed to form a plurality of cooling channels (26) defined by the supports, skin and substrate surface. An additional layer of material (42) may be deposited onto a top surface (50) of the cooling feature to provide additional thermal and/or mechanical protection.

17 Claims, 4 Drawing Sheets

COOLING STRUCTURE AND METHOD OF MANUFACTURING THE SAME

FIELD OF THE INVENTION

This invention relates generally to the field of thermal protection for components operating in a high temperature environment. More particularly, this invention relates to the fabrication of a cooling feature on the surface of a component substrate. This invention has specific application to the fabrication of a cooling feature on a curved surface of a combustion turbine hot section component.

BACKGROUND OF THE INVENTION

Combustion turbine engines generate combustion gases having temperatures that can exceed the allowable operating temperature of metals used to manufacture component parts of the turbine. Many cooling schemes are known for protecting such components, for example, the use of a film of cooling fluid and/or the application of an insulating material over the heated surface. It is also known to form a cooling feature integral to a component for conducting a cooling fluid through confined cooling channels near the component surface. Such cooling features may be formed by a casting process, or they may be machined into the part. However, it is difficult to form the cooling fluid channels of such cooling features to be close to the heated surface, since manufacturing tolerances must be accommodated in order to avoid an unintended break-through of the cooling channel through the component wall. Furthermore, the geometry of such cooling features is necessarily limited by the available casting and machining technologies, as well as manufacturing cost restrictions.

It is also known to apply a cooling panel to the surface of a portion of a gas turbine member to define a cooling flow channel through which a cooling fluid can travel to cool the turbine member. U.S. Pat. No. 6,018,950 issued on Feb. 1, 2000, to Scott Michael Moeller and assigned to Siemens Westinghouse Power Corporation describes one such cooling panel design. The cooling panel of the '950 patent is formed by using a corrugated metal member. The corrugations form channels through which a cooling gas may be circulated over the surface of the turbine member. The cooling gas serves to insulate the underlying substrate and to move heat energy away from the substrate material. A stamping process is used to form the corrugations in the metal member. The metal member is then attached to the turbine member by filet and spot welding. Such cooling panels may be used successfully on static portions of a combustion turbine. However, such panels would not be applicable for use on rotating members such as turbine blades, since the stresses exerted on such a member would increase the risk of mechanical failure of the weld joint between the panel and the underlying substrate. Furthermore, such panels would be difficult to apply to a curved surface.

It is also known to form a cooling feature on the surface of a substrate to provide channels for the passage of a cooling fluid over the substrate surface. One such device is described in an article by Kevin W. Kelly published in 1999 by The Minerals, Metals & Materials Society, Elevated Temperature Coatings, Science and Technology III, and titled "High Aspect Ratio Microstructure-Supported Shroud for a Turbine Blade." The micro heat exchanger is formed by electro-depositing an array of microstructures on a substrate surface, then affixing a metal shroud on top of the microstructures. Cooling passages defined by the spaces between the microstructures and below the shroud form cooling passages for conducting a cooling fluid over the substrate surface. The microstructures are formed by electro-plating a metal through holes formed in a sheet of polymer material that is applied to the surface of the substrate. The shroud is held in position over the microstructures by a shrink fit. The pattern of holes is formed in the polymer material by an X-ray lithography process. While this process is useful for a curved surface, it is limited in its commercial application by the cost of the X-ray lithography process and the difficulty of applying the sheet of polymer to the substrate. Furthermore, the attachment of a shroud to the microstructures with a mechanical shrink fit joint may be unacceptable for the environment of a rotating turbine blade.

SUMMARY OF THE INVENTION

Accordingly, an improved process and device for forming cooling features on a turbine component is needed.

A method of manufacturing a component is described herein as including: providing a substrate material having a surface; coating the substrate material surface with a layer of masking material; removing portions of the masking material by directing laser energy toward the masking material, a remaining portion of the masking material defining a pattern of voids wherein the substrate surface is exposed; electroplating a support material onto the exposed substrate surface within the voids to form a plurality of supports; electroplating a skin material onto the supports and over the remaining portion of the masking material to form a skin interconnecting the supports; and removing the remaining portions of the masking material to form cooling channels defined by the substrate surface, the supports and the skin. The skin material and the support material may be selected to be two different materials, and a layer of insulating material may be deposited on a top surface of the skin.

A method of manufacturing a component is further described herein as including: providing a substrate material having a surface; coating the substrate surface with a layer of masking material; removing portions of the masking material by directing laser energy toward the masking material, a remaining portion of the masking material defining a pattern of voids wherein the substrate surface is exposed; electroplating a support material onto the exposed substrate surface within the voids to form a plurality of supports; removing the remaining portions of the masking material; and bonding a skin member to the plurality of supports to form a plurality of cooling channels defined by the substrate surface, the supports and the skin member.

A method of manufacturing a component is further described herein as including: providing a substrate material having a surface; providing a skin member having a surface; coating the skin member surface with a layer of masking material; removing portions of the masking material by directing laser energy toward the masking material, a remaining portion of the masking material defining a pattern of voids wherein the skin member surface is exposed; electroplating a support material onto the exposed skin member surface within the voids to form a plurality of supports; removing the remaining portions of the masking material; and bonding the plurality of supports to the substrate surface to form a plurality of cooling channels defined by the substrate surface, the supports and the skin member.

A method of manufacturing a component is further described as including: providing a substrate having a surface; providing a skin member having a surface; coating the skin member surface with a layer of resin; removing portions of the masking material by directing laser energy toward the masking material, a remaining portion of the masking material defining a pattern of voids wherein the skin member surface is exposed; electroplating a support material onto the exposed skin member surface within the voids to form a plurality of supports; electroplating a base member material onto the supports and over the remaining portion of the masking material to form a base member interconnecting the supports; removing the remaining portions of the masking material to form cooling channels defined by the skin member surface, the supports and the base member; and bonding the base member to the substrate surface.

A combustion turbine component is described herein as including: a substrate material; a bond coat material disposed over a surface of the substrate material; an insulating material disposed over the bond coat material; and a cooling channel formed through the bond coat material for the passage of a cooling fluid over the surface of the substrate material and below the surface of the ceramic insulating material.

A combustion turbine component is further described as including: a substrate material; a plurality of supports formed of a support material joined to a surface of the substrate material by a diffusion bond; a skin formed of a skin material joined to the plurality of supports opposed the substrate material by a diffusion bond; the substrate material, supports and skin defining a plurality of cooling channels for the passage of a cooling fluid proximate the substrate material; wherein the support material and the skin material have different properties.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
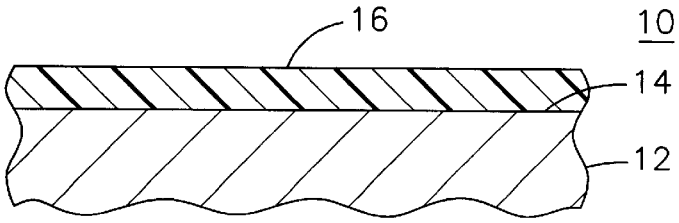
FIG. 1A illustrates a partial cross-sectional view of a component having a substrate and a layer of masking material disposed on the substrate surface.

FIG. 1A is a partial cross-sectional view of a component 10 having a substrate 12 with a top surface 14 that will be exposed to a high temperature environment. In one embodiment, such a component may be a rotating blade of a combustion turbine, since the invention described herein is useful for both flat and curved surfaces. The substrate material 12 may be metal such as a nickel or cobalt superalloy of stainless steel, such as for example IN 768, IN939, CMSX4, etc. A layer of a masking material 16 is disposed on the surface 14. One such masking material 16 is a polymer such as an epoxy resin. The masking material may be applied by a spray process or by dip coating or by other known process depending upon the desired thickness of the resin layer 16. The desired thickness may vary depending upon the requirements of the particular application, and for a turbine blade application may range from about 500 microns to about 1,000 microns, or about 2,000 microns or more.

Figure 1B:
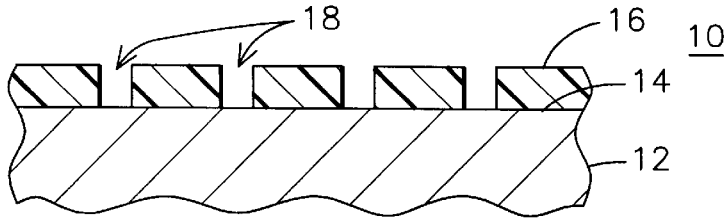
FIG. 1B is the component of FIG. 1A after being subjected to laser engraving to form a plurality of voids in the layer of masking material.

FIG. 1B shows the component 10 after portions of the layer of masking material 16 have been removed to leave a pattern of voids 18 in the resin layer 16. The surface 14 of the component 10 is exposed in the area of the voids 18. The process used to form the pattern of voids 18 may be material removal or selective deposition processes such as water carving, machining, injection molding, etc. In a preferred embodiment, a laser engraving process is used. The laser engraving process may utilize any type of laser at a power level sufficient to evaporate the resin without damaging the underlying metal component surface 14. In one embodiment, a YAG or $CO_2$ laser having a lens focal length of between 28 and 124 mm may be used at a linear cutting speed of between 100–600 mm/sec. A continuous wave may be used, or the laser energy may be pulsed at a frequency of between 1–20 kHz or between 3–8 kHz. The spot size of the laser may be varied to control the precision with which the voids 18 are formed. Any desired pattern of voids 18 may be formed, such as circular holes, lines, geometric patterns, etc.

Figure 1C:
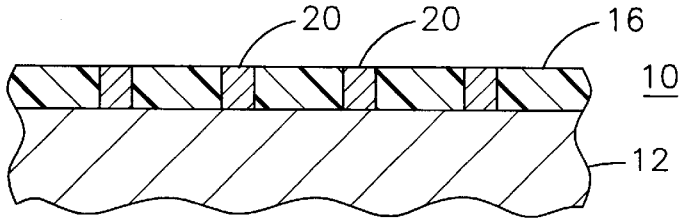
FIG. 1C is the component of FIG. 1B after having the voids filled by the electro-deposition of a metal to form a plurality of supports.

FIG. 1C shows the component 10 after a further manufacturing step wherein a plurality of supports 20 are formed in the spaces defined by the voids 18 of FIG. 1B. The supports 20 are formed by the electro-deposition of a support material such as a metal onto the surface 14. The support material may be selected to be any material capable of being electroplated onto the component surface 14 and having the desired mechanical properties. For the embodiment of a turbine blade, for example, the supports 20 may be formed of an MCrAlY alloy or a superalloy such as IN939. The supports 20 may then be bonded to the substrate surface 14 during a subsequent heat treatment process that will form a solid-state diffusion bond between the supports 20 and the substrate surface 14. Thus the supports 20 may be ruggedly attached to the substrate 12 without any adverse impact on the mechanical properties of the underlying substrate material 12.

Figure 1D:
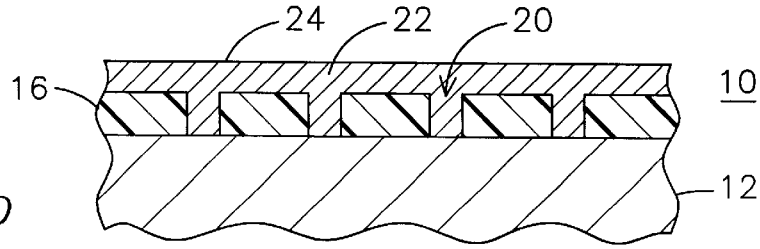
FIG. 1D is the component of FIG. 1C after the electro-deposition process is continued to form a skin interconnecting the supports.

FIG. 1D shows the condition of component 10 after the electo-plating process is allowed to continue to deposit a skin material to a level higher than the thickness of the layer of resin 16. The skin material may have different properties than the support material or may be simply the same as the support material. The skin and the support material may have different chemical compositions or they may have the same chemical compositions with a different crystalline structure. For example, if creep or fatigue properties of the outer layer of material is critical, it may be desirable to deposit a single crystal material for the skin. As the additional material is deposited onto the supports 20, it will extend over the top surface of the masking material and interconnect adjacent supports 20 to form a skin 22. The top surface 24 of the skin 22 may not be precisely planar in its as-deposited condition. The planarity of the top surface of the skin will depend upon the relative height and width of the support and the relative thicknesses of the resin layer 16 and the skin 22. If the as-deposited condition is not sufficiently planar, a post-processing planarization step may be used to remove material from the thickest portions of the skin 22. Advantageously, the electro-deposition process may be controlled to apply a very thin layer of skin material, such as for example as little as 40 mils or 25 mils (1000 microns or 625 microns) in order to facilitate heat transfer through the skin 22.

Figure 1E:
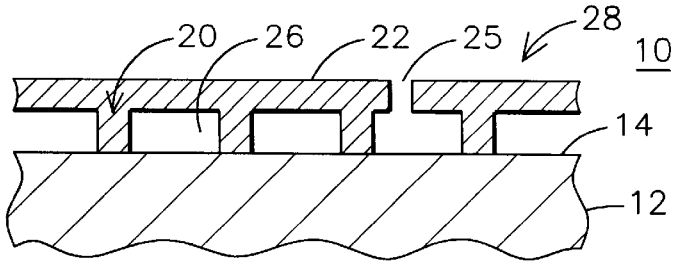
FIG. 1E is the component of FIG. 1D after the remaining portions of the masking material is removed to leave a plurality of cooling channels along the surface of the substrate.

FIG. 1E illustrates the component 10 after the remaining portions of the resin layer 16 have been removed, such as by being evaporated during a high temperature heat treatment of the component 10. Advantageously, such heat treatment step will concurrently remove the remaining portions of the resin layer and form the solid-state diffusion bond between the supports 20 and the substrate 12. Removal of the resin creates a plurality of cooling channels 26 defined by the supports 20, skin 22 and top surface 14 of the substrate 12. Together, the supports 20 and skin 22 function as a cooling feature 28 that may be used to direct a flow of cooling fluid across the surface 14 of component 10 to protect the component 10 from a high temperature environment. Cooling feature 28 is mechanically rugged and securely bonded to the underlying substrate surface 12. Importantly, the process described above may be used to for a cooling feature on a planar substrate surface or a curved substrate surface. The cooling channels 26 may be closed except at inlet and outlet ends, or where desired, an opening 25 may be formed through skin 22 to allow some of the cooling fluid contained in the cooling channel 26 to escape for the purposes of film cooling in an open loop cooling scheme. Opening 25 may be formed by any known material removal process, such as machining, laser engraving, etc.

Figure 2:
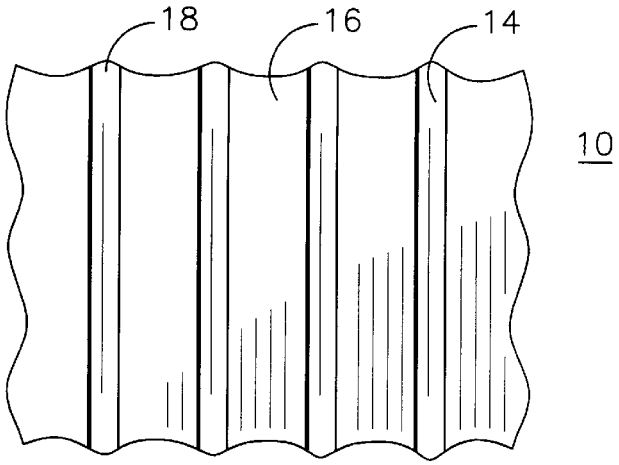
FIG. 2 is a top view of the component of FIG. 1B.
Figure 9:
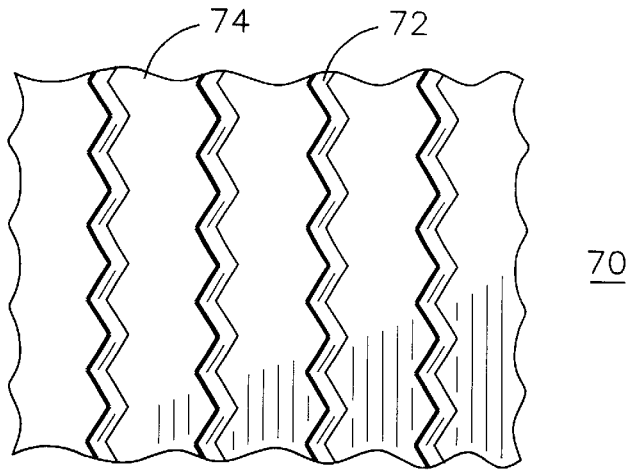
FIG. 9 is a top view of a component surface having a coating of masking material containing a zigzag pattern of voids formed therein.
Figure 10:
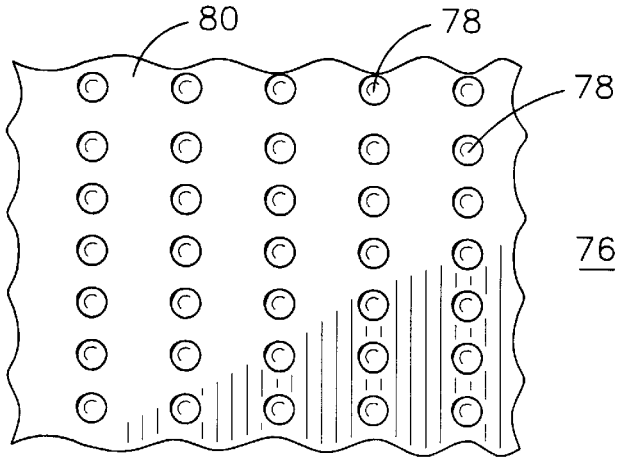
FIG. 10 is a top view of a component surface having a coating of masking material containing a plurality of circular voids formed therein.

FIG. 2 is a top view of the component 10 of FIG. 1B illustrating one possible pattern of voids 18 formed in a generally linear arrangement. The top surface 14 of the substrate is exposed in the areas of the voids 18 where the layer of resin 16 has been removed by laser engraving. This linear arrangement will produce linear cooling channels 26 when the steps illustrated in FIGS. 1C–1E are completed. The laser engraving step may be controlled to form other patterns, such as circular, spiral, triangular, serpentine or rectangular grid, etc. FIG. 9 is a top view of a component 70 having a zigzag pattern of voids 72 formed in a layer of masking material 74. After being processed through a the steps illustrated in FIGS. 1C–1E, a serpentine pattern of cooling channels would be formed. Similarly, FIG. 10 is a top view of a component 76 having a pattern of round voids 78 formed in a layer of resin masking material 80. After being processed through a the steps illustrated in FIGS. 1C–1E, an open pattern of cooling channels around round supports would be formed. Other patterns may be used, including triangular or rectangular shaped voids/supports.

Figure 3:
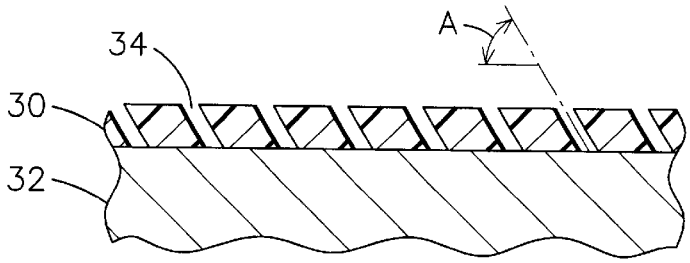
FIG. 3 is a partial cross-sectional view of a component having a substrate with a layer of masking material on its surface and a plurality of voids formed in the masking material by laser engraving at a non-perpendicular angle to the substrate surface.

FIG. 3 illustrates an embodiment of the present invention where laser energy has been directed toward a layer of resin 30 at a non-perpendicular angle "A" with respect to the plane of the surface of a substrate 32 to produce a plurality of cooling channels 34. During subsequent processing steps as described above, the cooling channels 34 may be filled with a material to form supports that would be inclined in relation to the surface of the substrate 32. Such an inclined geometry may be useful to the designer in order to optimize the flow of coolant over the substrate surface. The speed and precision of the laser engraving step provides the component designer with great flexibility in selecting an optimal geometry for any particular application.

Figure 4:
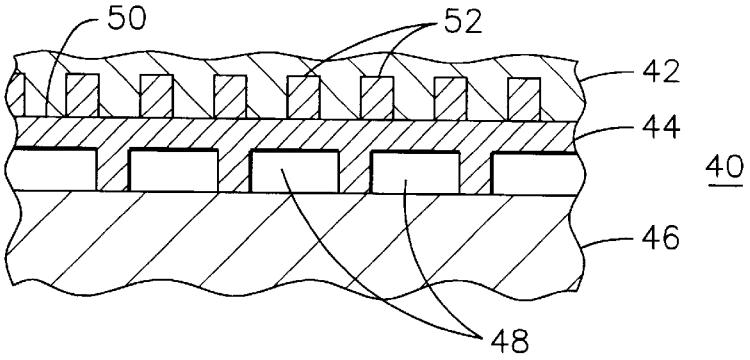
FIG. 4 is a partial cross-sectional view of a component having a cooling feature disposed on its surface, with the cooling feature further having a layer of reinforced ceramic insulating material on its surface.

A component 40 may be further protected from a high temperature and/or chemically or physically aggressive environment by the addition of a layer of material 42 over a top surface of a cooling feature 44 formed on the surface of a substrate 46, as illustrated in FIG. 4. The cooling feature 44 provides a plurality of cooling channels 48 for passing a cooling medium over the substrate 46. The process described above may be used to fabricate the cooling feature. The layer of material 42 provides additional protection to the cooling feature 44 and substrate 46 against physical impingement, chemical attack and/or heat. Material 42 may be a layer of metal or an alloy, such as an MCrAlY alloy as is known in the art, and/or it may be a ceramic insulating material. Examples of ceramic insulating materials that may be used include yttria stabilized zirconia; yttria stabilized hafnia; magnesium or calcium stabilized zirconia; ceramics with a pyrochlore structure with a formula $A_2B_2O_7$ where A is a rare earth element and B is zirconium, hafnium or titanium; or any oxide material that performs as a thermal barrier coating. The material 42 may be deposited by a thermal deposition process or by an electro-deposition process. FIG. 4 illustrates an embodiment wherein a ceramic insulating material 42 is supported on a top surface 50 of the cooling feature by a support structure 52. Support structure 52 is preferably formed of a metal or metal-ceramic composition deposited by an electro-deposition process and having a solid-state diffusion bond to the cooling feature 44. The support structure 52 may be formed by a masking, laser engraving, electro-deposition process similar to the one described above for the formation of the cooling feature. A layer of masking material is first deposited on a top surface 50 of the cooling feature 44, and a pattern of voids then formed in the masking material by laser engraving or photolithography. The support structure material is then deposited into the voids by an electro-deposition process. A solid-state diffusion bond is formed between the support structure 52 and the cooling feature 44 during a heat treatment process, during which the remaining portions of the masking material may be removed. The ceramic insulating material 42 may then be deposited onto the surface of the cooling feature around the support structure 52 by a thermal or electro-deposition process. A component may have certain surfaces where the structure of FIG. 4 is present, and other surfaces where the structure of FIG. 1E is present, as well as other surfaces where a ceramic insulating material is deposited without the use of a cooling feature. Accordingly, the designer is provided with additional flexibility in optimizing the thermal protection for a component that will be exposed to a high temperature environment.

Figure 5:
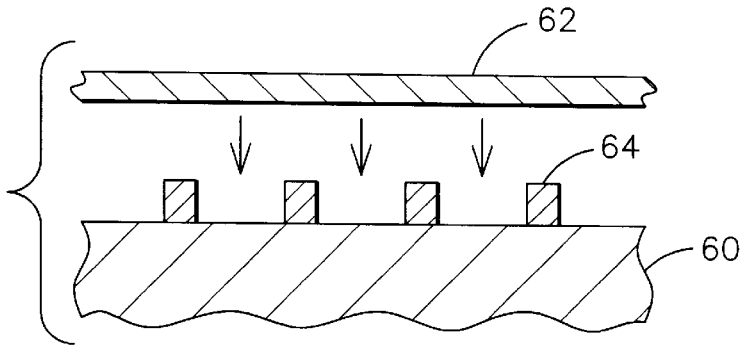
FIGS. 5–8 illustrate alternative locations for joining two subassemblies to form a cooling feature on a surface of a component.
Figure 6:
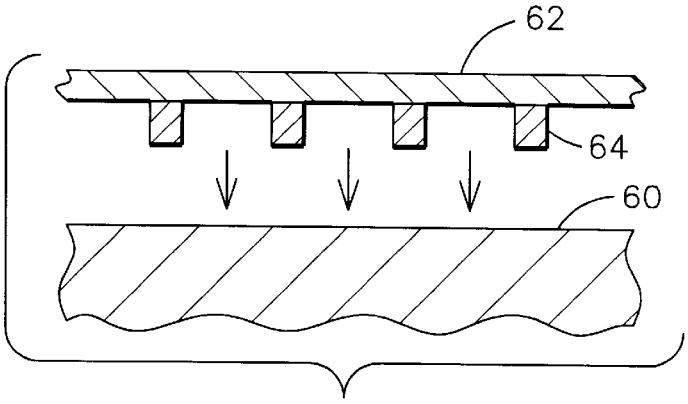
Figure 7:
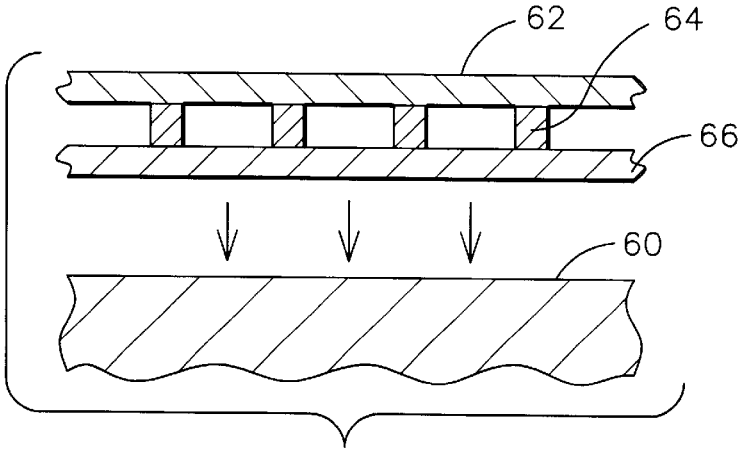
Figure 8:
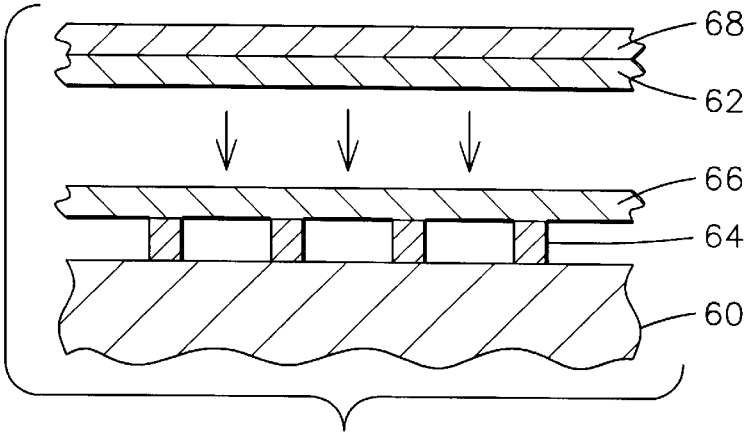

FIGS. 5–8 provide additional examples of how the process described above may be used to manufacture a component that is adapted for exposure to a high temperature environment. In each of these figures, two subassemblies are shown in position to be joined together to form a cooling feature on a substrate surface. Arrows in each of the figures denote the division between the two subassemblies and indicate the location of a bond that would subsequently be formed between the subassemblies. Brazing, transient liquid phase bonding, or other bonding process known in the art may be used to accomplish such bonding. The structure of the subassemblies and the location of the joint between the subassemblies vary among the figures. In each figure, a substrate 60 is attached to a thin skin member 62 directly or indirectly by a plurality of supports 64. The skin member may be a metal plate having a thickness in the range of 25–80 mils (625–2000 microns). The supports 64 are advantageously formed by the masking/laser engraving/electroplating process described above. In FIGS. 5 and 8 the supports 64 are formed directly onto the substrate 60. In FIGS. 6 and 7 the supports 64 are formed onto the skin member 62. In FIG. 7 an additional base member 66 is formed to interconnect the supports 64. A base member material may be electroplated onto the supports 64, such as in the manner of forming the skin 22 described in connection with FIG. 1E above. The joints within the various subassemblies may be solid-state diffusion bonds formed during a heat treatment step performed after the electroplating process, as described above. Once the two subassemblies are formed, they are joined together to form a final structure having a cooling feature disposed on the substrate 60. One may appreciate that the bond line between the two subassemblies may be selected in consideration of the temperature of the material during the operation of the component being formed. For example, the bond lines for the embodiments of FIGS. 5 and 8 are closest to the heated surface of the component, and therefore a joint in this location would operate at a higher temperature than would a joint formed at the bond lines of FIGS. 6 and 7 that are more removed from the heat source. An additional layer of material, such as the ceramic insulating material 68 illustrated in FIG. 8, may be deposited on the skin member 62 opposed the supports 64 to provide a further reduction in temperature at the joint location. Furthermore, the bond locations of FIGS. 7 and 8 provide a greater surface area for the joint than do the bond locations of FIGS. 5 and 6. Thus, the designer of a component is provided with additional flexibility in selecting the particular cooling scheme and manufacturing scheme for a particular application.

Figure 11:
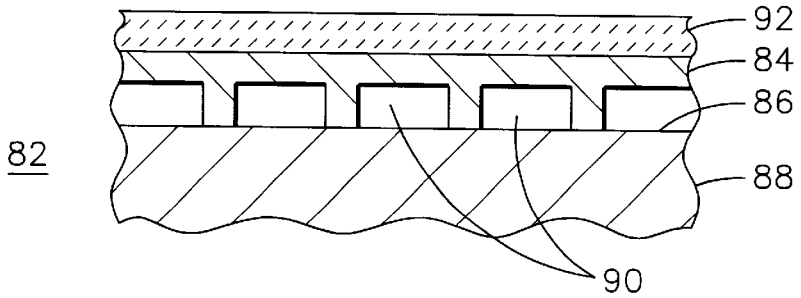
FIG. 11 is a cross-sectional view of a component surface bonded to a layer of ceramic insulating material by a layer of bond coat material that has formed therein a plurality of cooling passages.

FIG. 11 illustrates a component 82 formed to have a cooling feature 84 disposed on a surface 86 of a substrate material 88. The cooling feature 84 defines a plurality of cooling channels 90 through which a cooling fluid (not shown) may be passed over the substrate surface 86. A layer of ceramic insulating material 92 is disposed over the cooling feature 84. It is known in the art that the integrity of a layer of ceramic insulating material deposited on a metal substrate can be improved by the use of an intermediate layer of bonding material. The most common bonding materials used for joining superalloy substrates and ceramic insulating materials for combustion turbine applications are the MCrAlY alloys. Typically, such bond coat layers need be only about 5–7 mils (125–175 microns). In the embodiment of FIG. 11, the cooling feature 84 is formed of a bond coat material to function not only as a cooling fluid flow path structure but also as a bonding material to join the substrate metal 88 and the overlying ceramic insulating material 92. Accordingly, the bond coat in this application is deposited to a greater thickness than would be needed for just a bonding application. For example, layer 84 may be an MCrAlY material having a thickness of approximately 80 mils (2,000 microns). The MCrAlY material may be deposited by thermal spray processes, so the amount of time needed for the deposition of this additional thickness of bond coat material is not problematic.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A method of manufacturing a component, the method comprising:

providing a substrate material having a surface;

coating the substrate material surface with a layer of masking material by applying the masking material to the surface in a liquid state and allowing it to solidify;

removing portions of the masking material after the masking material has been applied to the substrate material surface, a remaining portion of the masking material defining a pattern of voids wherein the substrate surface is exposed;

depositing a support material onto the exposed substrate surface within the voids to form a plurality of supports;

depositing a skin material onto the supports and over the remaining portion of the masking material to form a skin interconnecting the supports; and removing the remaining portions of the masking material to form cooling channels defined by the substrate surface, the supports and the skin.

2. The method of claim 1, further comprising depositing at least one of the support material and the skin material by an electroplating process.

3. The method of claim 1, further comprising removing the portions of the masking material by directing laser energy toward the masking material.

4. The method of claim 1, wherein the step of depositing a support material comprises electroplating a support material and the step of depositing a skin material comprises continuing the step of electroplating the support material to form the supports and skin of the same material.

5. The method of claim 1, wherein the skin material and the support material are selected to be two different materials.

6. The method of claim 1, wherein the step of removing portions of the masking material further comprises directing laser energy toward the masking material at a non-perpendicular angle relative to the substrate surface.

7. The method of claim 1, further comprising forming an opening in the skin to be in fluid communication with one of the cooling channels.

8. The method of claim 1, further comprising bonding the skin member to the plurality of supports by a transient liquid phase bonding process.

9. The method of claim 1, further comprising depositing a layer of insulating material on a top surface of the skin.

10. The method of claim 9, wherein the step of depositing a layer of insulating material further comprises:

attaching a support structure onto the top surface of the skin; and depositing a ceramic insulating material onto the top surface of the skin around the support structure.

11. The method of claim 9, further comprising selecting the insulating material to be a ceramic insulating material and selecting the skin material to be a bond coat material.

12. The method of claim 11, wherein the substrate material is selected to be a superalloy material and the support material and skin material are selected to be an MCrAlY material.

13. A method of manufacturing a component, the method comprising:

providing a substrate material having a surface;

providing a skin member having a surface;

coating the skin member surface with a layer of masking material by applying the masking material to the surface in a liquid state and allowing it to solidify;

removing portions of the solidified masking material from the skin member surface by directing laser energy toward the masking material, a remaining portion of the masking material defining a pattern of voids wherein the skin member surface is exposed;

depositing a support material onto the exposed skin member surface within the voids to form a plurality of supports;

removing the remaining portions of the masking material;

bonding the plurality of supports to the substrate surface to form a plurality of cooling channels defined by the substrate surface, the supports and the skin member.

14. The method of claim 13, further comprising depositing a ceramic insulating material over the skin member opposed the supports.

15. The method of claim 13, wherein the masking material comprises an epoxy resin.

16. The method of claim 13, further comprising electroplating a base member material onto the supports and over the remaining portion of the masking material to form a base member interconnecting the supports.

17. The method of claim 16, wherein the base member is bonded to the substrate surface.

* * * * *